United States Patent [19]

Geschka

[11] Patent Number: 4,599,595

[45] Date of Patent: Jul. 8, 1986

[54] LAMINATED IRON CORE FOR TRANSFORMERS, CHOKE COILS AND THE LIKE

[75] Inventor: Hugo W. Geschka, Düsseldorf, Fed. Rep. of Germany

[73] Assignee: E. Blum GmbH & Co., Vaihingen, Fed. Rep. of Germany

[21] Appl. No.: 566,144

[22] Filed: Dec. 28, 1983

Related U.S. Application Data

[63] Continuation of Ser. No. 449,632, Dec. 14, 1982, abandoned, which is a continuation of Ser. No. 170,776, Jul. 21, 1980, abandoned, which is a continuation of Ser. No. 908,521, May 22, 1978, abandoned.

[30] Foreign Application Priority Data

May 21, 1977 [DE] Fed. Rep. of Germany ..... 2723099

[51] Int. Cl.[4] ..... H01F 27/24

[52] U.S. Cl. ..... 336/178; 336/212; 336/216

[58] Field of Search ..... 336/178, 165, 133, 134, 336/135, 210, 216, 217, 219, 212, 234

[56] References Cited

U.S. PATENT DOCUMENTS

| | | | |
|---|---|---|---|
| 1,615,018 | 1/1927 | Langdon-Davies et al. | 336/135 X |
| 1,756,875 | 4/1930 | Montsinger | 336/134 X |
| 1,767,058 | 6/1930 | Eisenman | 336/135 X |
| 2,133,919 | 10/1938 | Fries | 336/133 |
| 3,356,822 | 12/1967 | Bennett | 336/134 X |
| 3,546,571 | 12/1970 | Fletcher et al. | 336/165 |
| 3,576,508 | 4/1971 | Liberman | 336/165 |

FOREIGN PATENT DOCUMENTS

| | | | |
|---|---|---|---|
| 344371 | 11/1936 | Italy | 336/134 |
| 46118 | 2/1929 | Norway | 336/135 |

OTHER PUBLICATIONS

"Problems Related to Cores of Transformers and Reactors," H. Kan, report of the discussion at the Colloquium of Study Committee 12, (Transformers) in Aachen (FRG), Sep. 1983.

*Primary Examiner*—Thomas J. Kozma
*Attorney, Agent, or Firm*—Peter K. Kontler

[57] ABSTRACT

Laminated iron core for transformers, choke coils and the like includes a plurality of core parts overlying one another at respective mutually opposing abutment locations, the respective mutually opposing abutment locations defining a space of varying width between one another, the core parts being disposed so as to form a relatively short closed inner path and increasingly longer closed outer paths for magnetic force lines, the space having a region of relatively greater width across which the relatively short closed inner path extends.

7 Claims, 1 Drawing Figure

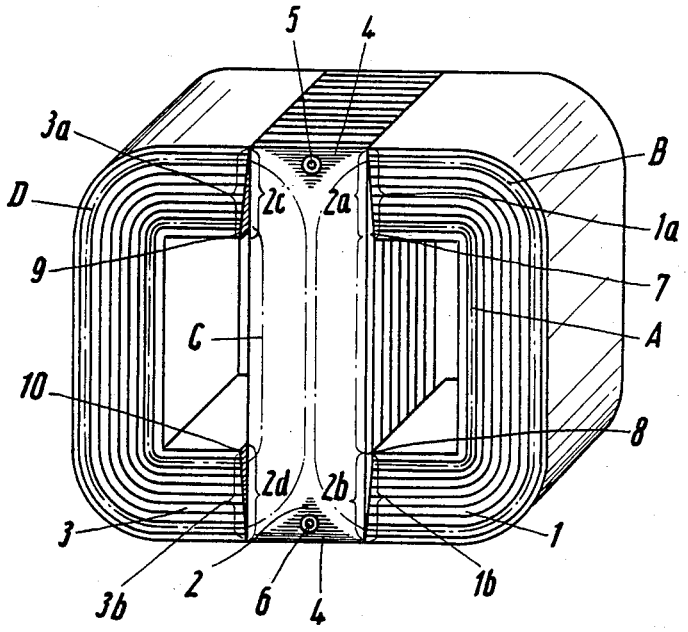
5
4
3a
B
D
2c
2a
1a
9
7
C
A
10
8
2d
2b
3
1
3b
2
6
4
1b

LAMINATED IRON CORE FOR TRANSFORMERS, CHOKE COILS AND THE LIKE

This application is a continuation of Ser. No. 449,632 filed Dec. 14, 1982, now abandoned. The application Ser. No. 449,632 is a continuation of Ser. No. 170,776 filed July 21, 1980, now abandoned. The application Ser. No. 170,776 is a continuation of Ser. No. 908,521 filed May 22, 1978, now abandoned.

The invention relates to laminated iron cores for transformers, choke coils and the like, such as have become known heretofore from German Utility Model No. 7 403 587 and which are formed of a plurality of core parts mutually overlying at abutment locations.

The invention stems from the fact that, at the abutment locations of the laminated iron core, at which the magnetic force lines are deflected or diverted, a problem of effecting uniform distribution of the force lines arises. Since the force lines always choose the shortest path, a concentration and consequent supersaturation occurs at the corner zones of the transition locations of the iron core, resulting in local heating until burn-up and eddy current losses occur.

It is accordingly an object of the invention to provide a laminated iron core for transformers, choke coils and the like which avoids these disadvantages of heretofore known laminated iron cores of this general type and which, more particularly, avoids concentration and supersaturation of force lines at the corner zones of the abutment locations and, thereby, local overheating and eddy current losses.

With the foregoing and other objects in view, there is provided, in accordance with the invention, a laminated iron core for transformers, choke coils and the like comprising a plurality of core parts overlying one another at respective mutually opposing abutment locations, the respective mutually opposing abutment locations defining a space of varying width between one another, the core parts being disposed so as to form a relatively short closed inner path and increasingly longer closed outer paths for magnetic force lines, the space having a region of relatively greater width across which the relatively short closed inner path extends.

This means that the greatest width of the air space must be overcome by the shortest path of the force lines, whereas the abutment locations may engage one another at the longest path. The force lines are thereby required to distribute themselves substantially uniformly over the entire abutment location.

In accordance with another feature of the invention, the abutment locations are of such construction that the product of the resistance resulting from the respective space over the respective abutment location and the length of the magnetic force line paths at each section of the respective abutment location is substantially equal.

In accordance with a further feature of the invention, the respective mutually opposing abutment locations extend at an angle of from 1 to 6 minutes from one another.

In accordance with an added feature of the invention, the laminated iron core includes a laminated yoke member and at least one laminated casing defining with the yoke member the closed paths for the magnetic force lines, the casing being formed with at least one leg portion having one of the abutment locations at an end thereof and overlying a corresponding abutment location on the yoke member, the abutment locations on the leg portion and the yoke member having respective surfaces, at least one of the surfaces being formed with an inclination toward the other surface so that the surfaces gradually extend farther away from one another, the space therebetween having a region of relatively slight width across which relatively longer closed outer paths extend. From the manufacturing standpoint, it can be especially advantageous if the leg portion or portions have a bevel or inclined surface formed at the respective abutment location thereof, which can, for example, be ground and then lapped.

In accordance with an additional feature of the invention, the casing is formed of two lateral leg portions and a middle leg portion extending between and secured to respective ends of the lateral leg portions.

In accordance with yet another feature of the invention, the leg portions and the yoke member have a substantially parallelepipedal shape.

In accordance with yet a further feature of the invention, the space defined by the respective mutually opposing abutment locations is filled with a material different from the material forming the core parts.

In accordance with yet an added feature of the invention the space-filling material is insulating material.

In accordance with a concomitant feature of the invention, the space-filling material is an adhesive material. Thereby, in a very effective manner, corrosion or rust-formation in the wedge-shaped spaces can be prevented and the iron core according to the invention can also find application in choke coils.

Other features which are considered as characteristic of the invention are set forth in the appended claims.

Although the invention is illustrated and described herein as embodied in laminated iron core for transformers, choke coils and the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

the single FIGURE of the drawing is a perspective view of one embodiment of a laminated iron core for transformers, chokes and the like which is constructed in accordance with the invention.

Referring now to the drawing, there is shown a laminated iron core formed of three core parts 1, 2 and 3, of which the core parts 1 and 3 are formed by winding and subsequent severing, and the iron core part 2 by punching out sheetmetal parts and superimposing them in layers, those sheetmetal parts being connected to one another by rivets 5 and 6 in vicinity of magnetically ineffective zones 4 thereof.

Each core part 1, 2, 3 has an abutment or contact location at a region thereof disposed opposite a respective other core part, namely the core part 1 has two abutment locations 1*a* and 1*b* for the core part 2, the core part 2, in turn, has two abutment locations 2*a* and 2*b* opposite the core part 1 and, furthermore, two abutment locations 2*c* and 2*d* opposite abutment locations 3*a* and 3*b* of the core part 3.

The abutment locations 1*a* and 1*b* as well as 3*a* and 3*b* advantageously have a formed bevel or inclined surface in the order of magnitude of 1 to 6 angular minutes, due to which a varying spacing or clearance 7, 8, 9 or 10 between respective abutment locations is formed. Consequently, force lines, which always endeavor to select the shortest path to the abutment locations, namely to pass from the inner region of the c-shaped core parts 1 and 3 into the middle core 2 and in reverse direction, are opposed by a very great resistance at the abutment locations, whereby force lines are also shifted outwardly and thereby prevent a concentration at the region corresponding to the shortest path i.e. local overheating and supersaturation is avoided, and uniform distribution of the magnetic field lines over the abutment locations occurs. It is readily apparent that then the shorter force lines A, C extend or are intentionally disposed with the short path in the region of the greater spacing or clearance between opposing abutment locations, and the longer force lines B, D with the longest paths in the region of the least spacing or clearance between the opposing abutment locations.

In the same manner in which the abutment locations 1*a*, 1*b*, 3*a* and 3*b* are provided with respective bevels or inclinded surfaces, so also can the abutment locations 2*a* and 2*b*, 2*c* and 2*d* be provided with respective or, bevels alternatively, only the latter abutment locations 2*c* and 2*d* of the middle core 2. It is advantageous if the bevels or inclined surfaces are selected so that the products of the path length of the force lines and the resistance at each region of opposed abutment locations 1*a*/2*a*, 1*b*/2*b*, 2*c*/3*a* and 2*d*/3*b* are substantially equal or that at least the resistance in the region of the shorter force lines is increased.

The invention, as hereinaforementioned, is not limited to the aforedescribed embodiment, which is shown in the drawings, but rather, is also embodied, for example, in a transformer wherein both the transverse yokes as well as the side legs and, if necessary, the middle legs are formed of parallelpipedal or otherwise constructed laminated iron core parts.

What is claimed is:

1. Iron core for transformers, choke coils and like devices having a plurality of core parts each formed of held-together laminate plates, said core parts including pairs of neighboring core parts which are inclined relative to each other and overlie one another with mutually opposing surfaces thereof in a manner such that magnetic force lines within the laminate plates of neighboring core parts or emerging therefrom undergo a corresponding change in direction, comprising means defining a space which constitutes an at least substantially uniformly varying clearance between the respective mutually opposing surfaces and terminating at a mutual contact location thereof, said clearance being substantially less than one degree and said mutually opposing surfaces of said core parts being disposed so as to define a relatively short inner path and a longer outer path for magnetic force lines, each of said spaces having a region of relatively greater clearance across which said relatively short inner path extends, said longer outer path extending through said mutual contact locations of the respective mutually opposing surfaces, the surface of one of each pair of core parts being planar and extending across the entire width and length of one end of said one core part and the surface of the other part of each pair of core parts being planar and having at least the same width and length as the planar surface of the respective one core part.

2. Laminated iron core according to claim 1 wherein a casing in strip-wound form is subdivided at the respective regions thereof so as to form some of the laminated core parts, said core parts including at least one additional laminated core part constituting a central laminated core member assembled with the casing and engaging therewith in the region of subdivision thereof, the laminations of one of the casing parts and the laminations of the central core member intersecting grid-like with one anothe and each varying clearance extending at an angle of between 1 and 6 minutes between the central core member and the one casing part in the region of subdivision of the latter.

3. Laminated iron core according to claim 1 wherein each said space is filled with a material different from the material forming said core parts.

4. Laminated iron core according to claim 1 wherein the core parts comprise leg protions and yoke members assembled together to form the respective core part, said leg portions and yoke members being substantially parallelepipedal and having said mutually opposing surfaces, such surfaces extending at mutual inclinations within a range from 1 to 6 angular minutes.

5. Iron core according to claim 1 wherein the product of resistance resulting from the clearance at a respective point of said mutually opposing surface with the length of the respective path for magnetic force lines passing through the respective point is substantially equal to the respective product at all respective points of said mutually opposing surfaces.

6. Iron core according to claim 1, wherein said clearance is between 1 to 6 angular minutes and the magnetic force lines are deflectable out of said paths in the vicinity of said mutually opposing surfaces.

7. Iron core according to claim 1, wherein said core parts are parallelepipeds and said corresponding change in direction of magnetic force lines is at least substantially 90 degrees.

* * * * *